US010703113B2

(12) United States Patent
Matsuki et al.

(10) Patent No.: US 10,703,113 B2
(45) Date of Patent: Jul. 7, 2020

(54) LIQUID DISCHARGE APPARATUS AND METHOD FOR DISCHARGING LIQUID

(71) Applicants: Yuusuke Matsuki, Kanagawa (JP); Atsushi Yanaka, Saitama (JP); Daisuke Mezaki, Kanagawa (JP)

(72) Inventors: Yuusuke Matsuki, Kanagawa (JP); Atsushi Yanaka, Saitama (JP); Daisuke Mezaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/292,379

(22) Filed: Mar. 5, 2019

(65) Prior Publication Data

US 2019/0275810 A1 Sep. 12, 2019

(30) Foreign Application Priority Data

Mar. 6, 2018 (JP) ..... 2018-039727

(51) Int. Cl.

| | |
|---|---|
| ***B41J 11/00*** | (2006.01) |
| ***B41J 2/01*** | (2006.01) |
| ***B41M 7/00*** | (2006.01) |
| ***H05B 45/00*** | (2020.01) |

(52) U.S. Cl.

CPC ..... *B41J 11/002* (2013.01); *B41J 2/01* (2013.01); *B41M 7/0081* (2013.01); *H05B 45/00* (2020.01)

(58) Field of Classification Search

CPC ..... B41J 11/002; B41J 2/145; B41M 7/0081; H05B 33/0803

USPC ..... 347/37, 101, 102, 104

See application file for complete search history.

(56) References Cited

U.S. PATENT DOCUMENTS

| | | | | |
|---|---|---|---|---|
| 5,638,105 | A * | 6/1997 | Murata | B41J 2/355 347/171 |
| 8,177,350 | B2 * | 5/2012 | Mitsuzawa | B41J 11/002 347/102 |
| 2016/0152043 | A1 | 6/2016 | Mezaki | |
| 2017/0080720 | A1 | 3/2017 | Mezaki | |
| 2018/0207956 | A1 | 7/2018 | Mezaki | |

FOREIGN PATENT DOCUMENTS

| | | |
|---|---|---|
| JP | 2006-224337 | 8/2006 |
| JP | 2011-131441 | 7/2011 |
| JP | 2014-117799 | 6/2014 |

* cited by examiner

*Primary Examiner* — An H Do

(74) *Attorney, Agent, or Firm* — Oblon, McClelland, Maier & Neustadt, L.L.P.

(57) ABSTRACT

A liquid discharge apparatus includes a liquid discharge head to discharge a liquid onto a recording medium conveyed in a sub-scanning direction, an irradiator to irradiate the liquid discharged onto the recording medium with a curing ray, an irradiation area of the curing ray being variable in the sub-scanning direction, and a scanner to scan the liquid discharge head and the irradiator in a main scanning direction perpendicular to the sub-scanning direction.

12 Claims, 16 Drawing Sheets

LIQUID DISCHARGE APPARATUS AND METHOD FOR DISCHARGING LIQUID

CROSS-REFERENCE TO RELATED APPLICATIONS

This patent application is based on and claims priority pursuant to 35 U.S.C. § 119(a) to Japanese Patent Application No. 2018-039727, filed on Mar. 6, 2018, in the Japan Patent Office, the entire disclosure of which is incorporated by reference herein.

BACKGROUND

Technical Field

The present disclosure relates to a liquid discharge apparatus and a method for discharging liquid.

Discussion of the Background Art an image forming method is known in which an inkjet recording apparatus, in particular, an apparatus having an ultraviolet (UV) ink mounted on the apparatus controls a time interval from discharge of an ink to irradiation of UV light or controls a light source output to control the shape of an outermost surface of a recorded image.

In general, light irradiation is performed by a light source immediately after discharge of an ink, and an ink is cured to form a recorded image. However, there is also an image forming method for performing light irradiation with a time interval after discharge of an ink. For example, in a method called coating, an ink is discharged onto a recording medium, the ink is irradiated with UV light after a certain period of time elapses, and a surface of the cured ink is thereby smoothed to impart glossiness. In addition, time from discharge of an ink to UV light irradiation is adjusted to control glossiness.

It is known to adjust the time to UV light irradiation by ON/OFF of light irradiation. For example, a light source is turned off in a scan at the time of discharge of an ink (one scan), and UV light irradiation is performed without discharging the ink in a subsequent scan to cure the ink discharged in the previous scan. In this case, a boundary between a cured portion and an uncured portion is generated due to curing shrinkage of the ink when the ink is irradiated with UV light to cause a chemical reaction. Such a boundary is generated in a band shape in a head scanning direction, and so-called banding of a recorded image occurs.

To prevent banding, a light source having a larger size and a longer length than a recorded image is mounted on an apparatus, resulting in an increase in size and complexity of the apparatus. In a case of preparing such a light source in a separate process, it is difficult to inline the light source for an industrial use.

SUMMARY

In an aspect of this disclosure, a novel liquid discharge apparatus includes a liquid discharge head to discharge a liquid onto a recording medium conveyed in a sub-scanning direction, an irradiator to irradiate the liquid discharged onto the recording medium with a curing ray, an irradiation area of the curing ray being variable in the sub-scanning direction, and a scanner to scan the liquid discharge head and the irradiator in a main scanning direction perpendicular to the sub-scanning direction.

In another aspect of this disclosure, a novel method for discharging a liquid includes discharging liquid onto a recording medium conveyed in a sub-scanning direction, irradiating the liquid discharged onto the recording medium with a curing ray, an irradiation area of the curing ray being variable in the sub-scanning direction, and scanning a position of the discharging and a position of the irradiating in a main scanning direction perpendicular to the sub-scanning direction.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1A:
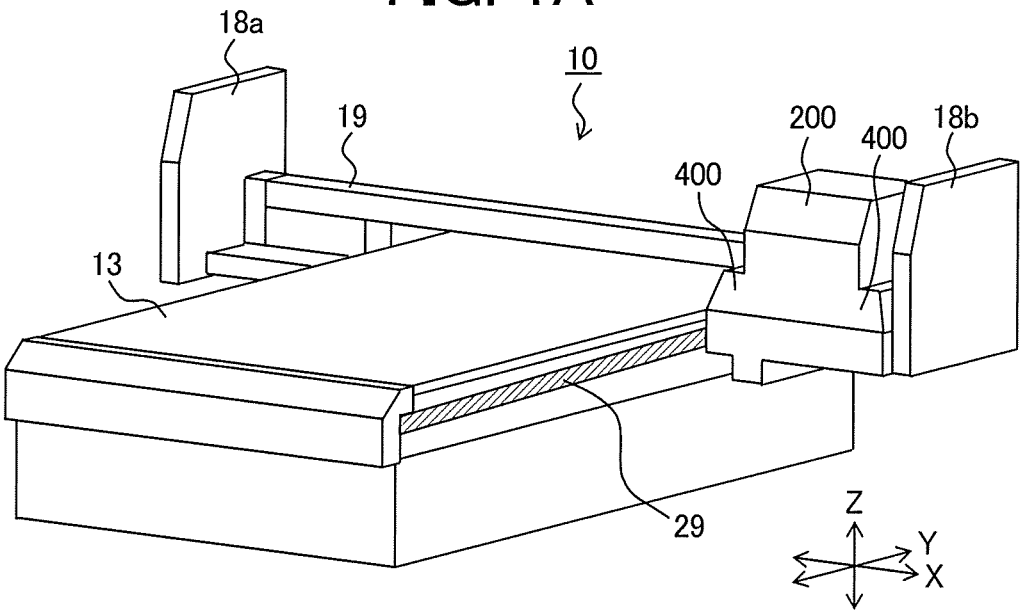
FIGS. 1A and 1B are perspective views illustrating a general arrangement of an example of a liquid discharge apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, a liquid discharge apparatus and a method for discharging liquid according to an embodiment of the present disclosure is described with reference to the drawings. Note that the present disclosure is not limited to the embodiments described below but can be changed within a range which a person skilled in the art can conceive of, for example, by another embodiment, addition, modification, or deletion. Any aspect is included in the scope of the present disclosure as long as exhibiting an action and an effect of the present disclosure.

(Liquid Discharge Apparatus and Method for Discharging Liquid)

First, a general arrangement of a liquid discharge apparatus according to an embodiment of the present disclosure is described.

Figure 1B:
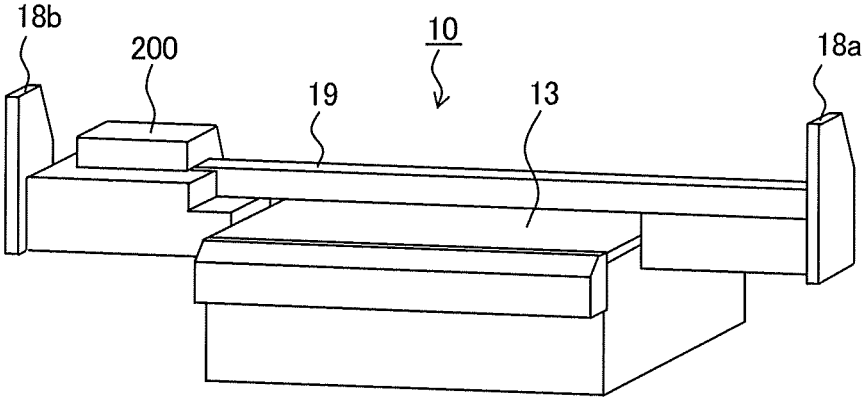

FIGS. 1A and 1B are perspective views illustrating a general arrangement of an inkjet recording apparatus as an example of the liquid discharge apparatus. FIG. 1A is a perspective view seen from the front side of the apparatus, and FIG. 1B is a perspective view seen from the rear side of the apparatus.

An inkjet recording apparatus 10 includes a carriage 200 and a stage 13 on which a recording medium is placed. The carriage 200 is an inkjet type carriage including a plurality of liquid discharge heads 300 provided with a plurality of nozzles, and discharges liquid from the nozzles of the liquid discharge heads to form an image. The nozzles are disposed on a surface facing the stage 13. Note that the liquid is ultraviolet-curable as an example in the present embodiment.

Hereinafter, the "liquid discharge head" is simply referred to as the "head".

An irradiator 400 which is a light source for emitting an ultraviolet ray is disposed on a surface of the carriage 200 facing the stage 13. The irradiator 400 (an example of an irradiator) emits light having a wavelength for curing liquid discharged from the nozzles.

A guide rod 19 is bridged across left-side plate 18*a* and the right-side plate 18*b* to hold the carriage 200 so as to be movable in an X direction (main scanning direction). The carriage 200, the guide rod 19, and the left-side plate 18*a* and the right-side plate 18*b* are integrally movable in a Y direction (sub-scanning direction) along a guide rail 29 disposed at a lower portion of the stage 13. Furthermore, the carriage 200 is held movably in a Z direction (vertical direction).

Next, another embodiment is described by describing an example of a hardware configuration.

Figure 2:
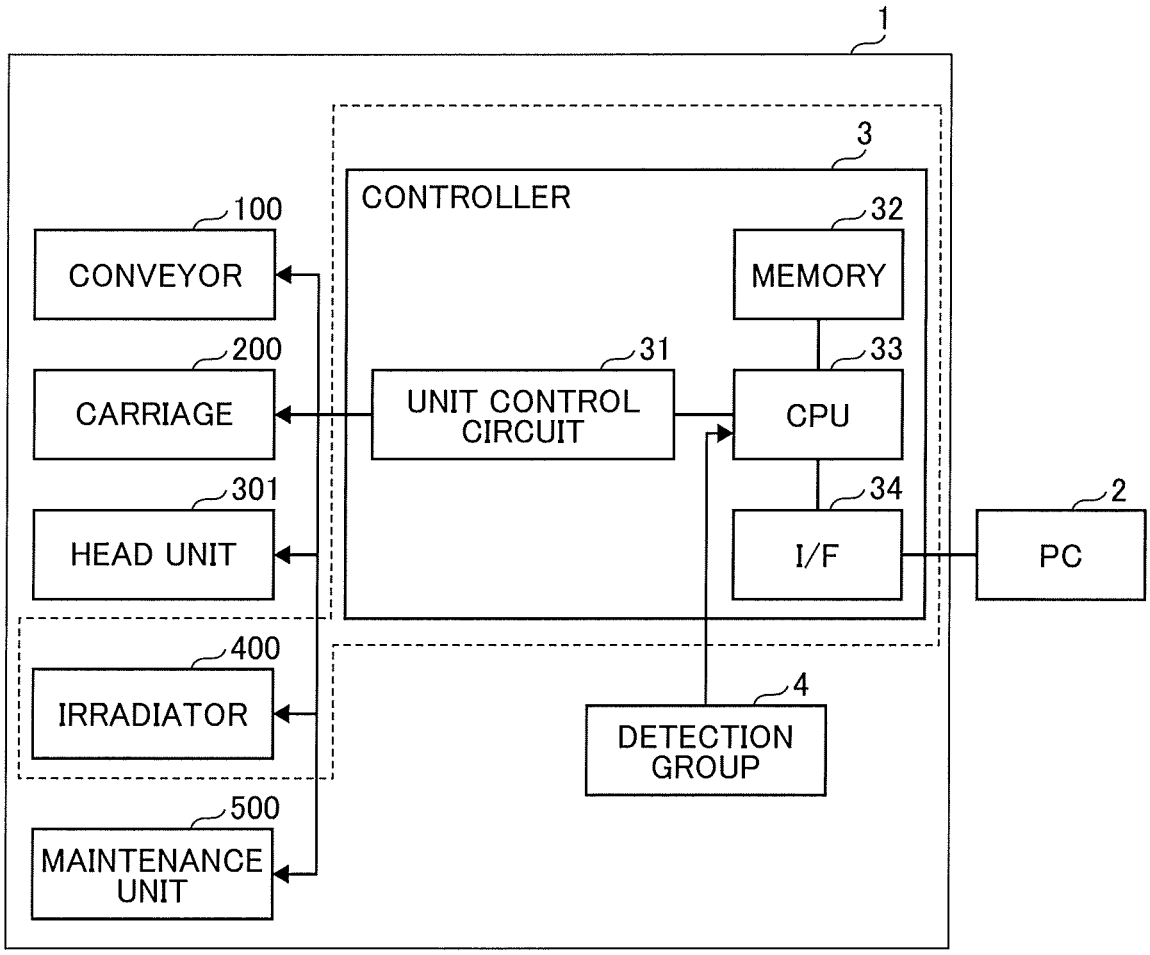
FIG. 2 is a block diagram of a hardware configuration of an example of a liquid discharge apparatus according to an embodiment of the present disclosure.
Figure 3:
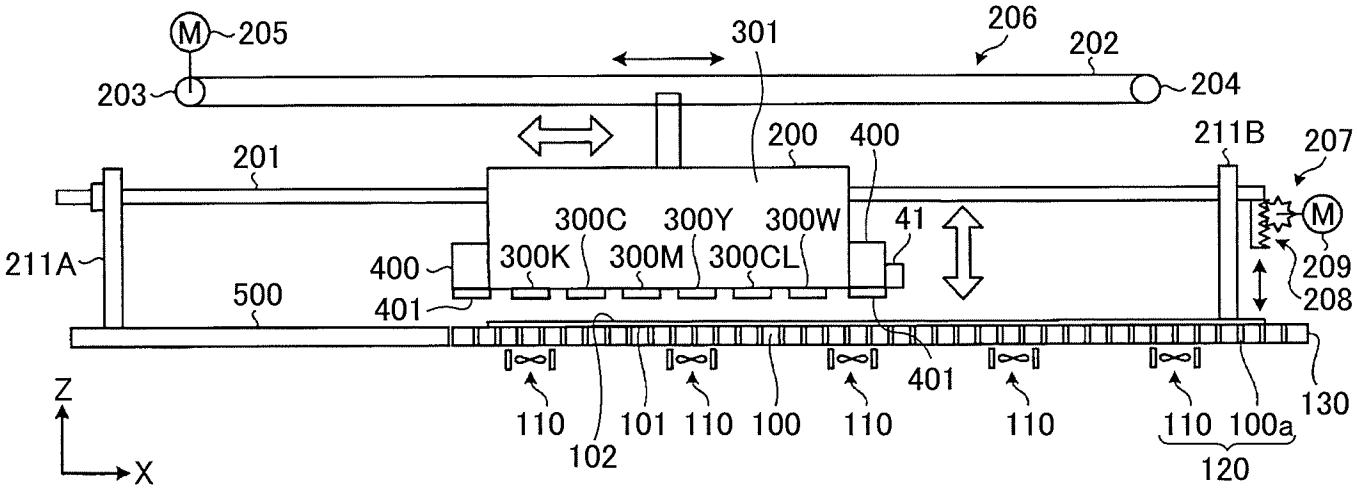
FIG. 3 is a front view of an example of a liquid discharge apparatus according to an embodiment of the present disclosure.
Figure 4:
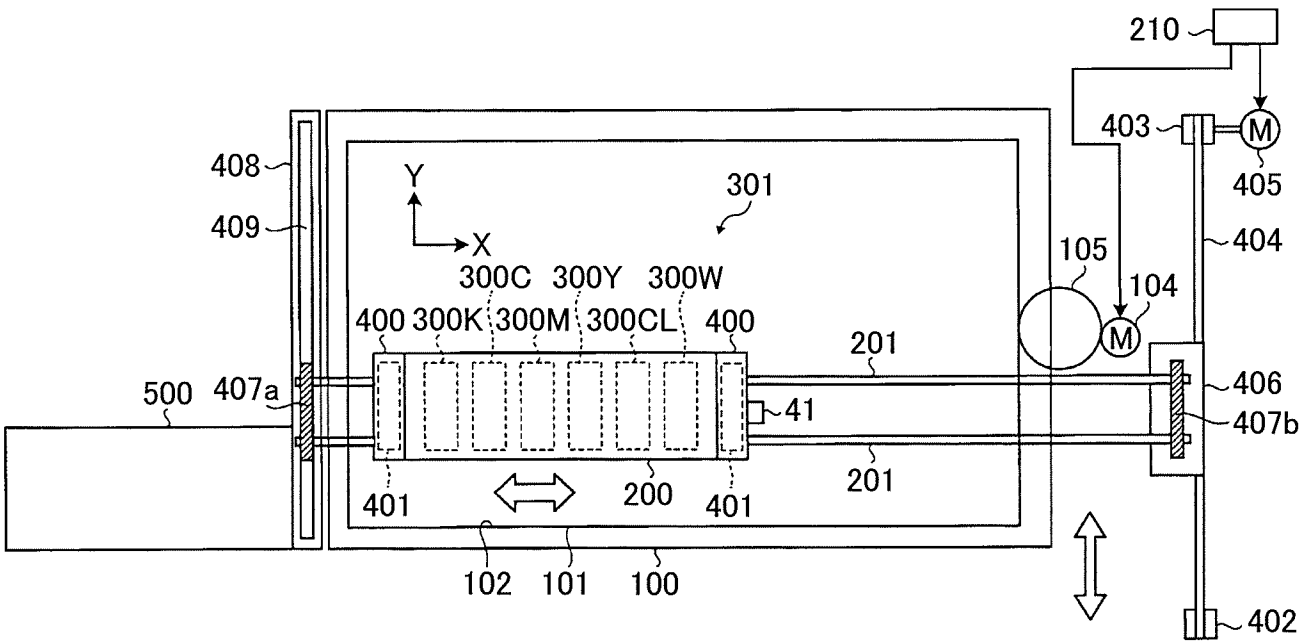
FIG. 4 is a plan view of an example of a liquid discharge apparatus according to an embodiment of the present disclosure.

FIG. 2 is a block diagram illustrating an example of a hardware configuration of a liquid discharge apparatus 1 according to the present disclosure. FIG. 3 is a schematic view illustrating an example of a front view of the liquid discharge apparatus 1 according to the present disclosure. FIG. 4 is a schematic view illustrating an example of a plan view of the liquid discharge apparatus 1 according to the present disclosure.

As illustrated in FIG. 2, the liquid discharge apparatus 1 according to the present embodiment includes a controller 3, a detection group 4, a conveyor 100, a carriage 200, a head unit 301 (an example of a liquid discharge head), an irradiator 400 (an example of an irradiator), and a maintenance unit 500. The controller 3 includes a unit control circuit 31, a memory 32, a central processing unit 33 (CPU), and an interface 34 (I/F). Incidentally, as illustrated by a broken line in FIG. 2, the liquid discharge apparatus 1 only needs to include at least the controller 3 and the irradiator 400.

The I/F 34 is an interface for connecting the liquid discharge apparatus 1 to an external personal computer 2 (PC). A connection form between the liquid discharge apparatus 1 and the PC 2 may be any form, and examples thereof include connection via a network and a form in which the liquid discharge apparatus 1 and the PC 2 are connected directly to each other with a communication cable.

Examples of the detection group 4 include various sensors included in the liquid discharge apparatus 1, such as a height sensor 41 illustrated in FIGS. 3 and 4.

The CPU 33 uses the memory 32 as a work area to control operation of each unit in the liquid discharge apparatus 1 via the unit control circuit 31. Specifically, the CPU 33 controls operation of each unit based on record data received from the PC 2 and data detected by the detection group 4 and forms an image which is a liquid application surface 102 on a recording medium 101 (also referred to as a substrate).

Note that a printer driver is installed in the PC 2, and recorded data to be transmitted to the liquid discharge apparatus 1 is generated from the image data by the printer driver. The recorded data includes command data for operating the conveyor 100 or the like of the liquid discharge apparatus 1 and pixel data concerning an image (liquid application surface 102). The pixel data includes 2-bit data for each pixel and is expressed by 4 gradations.

The conveyor 100 includes a stage 130 and an adsorption mechanism 120. The adsorption mechanism 120 includes a fan 110 and a plurality of adsorption holes 100*a* formed in the stage 130. The adsorption mechanism 120 drives the fan 110 and adsorbs the recording medium 101 from the adsorption holes 100*a* to temporarily secure the recording medium 101 to the conveyor 100. The adsorption mechanism 120 may adsorb a sheet by electrostatic adsorption. Movement of the conveyor 100 in the Y-axis direction (sub-scanning direction) is controlled based on a drive signal from the CPU 33 (unit control circuit 31).

As illustrated in FIG. 4, the conveyor 100 includes a conveyance controller 210, a roller 105, and a motor 104. The conveyance controller 210 drives the motor 104 and rotates the roller 105 to move the recording medium 101 in the Y axis direction (sub-scanning direction).

The conveyor 100 may move the carriage 200 in the Y axis direction (sub-scanning direction) instead of the recording medium 101. That is, the conveyor 100 relatively moves the recording medium 101 and the carriage 200 in the Y axis direction (sub-scanning direction).

For example, as illustrated in the right side of FIG. 4, the conveyor 100 includes a side plate 407*b* supporting two guides 201 for guiding the carriage 200 in the X axis direction (main scanning direction), a table 406 supporting the side plate 407*b*, a belt 404 fixed to the table 406, a driving pulley 403 and a driven pulley 402 around which the belt 404 is wound, a motor 405 for rotationally driving the driving pulley 403, and the conveyance controller 210.

As illustrated in the left side of FIG. 4, the conveyor 100 further includes a side plate 407*a* supporting the two guides 201 for guiding the carriage 200 in the X axis direction (main scanning direction), a table 408 supporting the side plate 407*a* so as to be slidable, and a groove 409 formed in the table 408 for guiding the side plate 407*a* in a sub-scanning direction.

In the conveyor 100, the conveyance controller 210 drives the motor 405 and thereby rotates the driving pulley 403 to move the belt 404 in the Y axis direction (sub-scanning direction). The table 406 supporting the carriage 200 moves in the Y axis direction (sub-scanning direction) with movement of the belt 404, and the carriage 200 can thereby move in the Y axis direction (sub-scanning direction). The side plate 407*a* moves in the Y axis direction (sub-scanning direction) along the groove 409 of the table 408 with movement of the table 406 in the Y axis direction (sub-scanning direction).

The head unit 301 includes heads 300K, 300C, 300M, 300Y, 300CL, and 300W for discharging UV curable inks (an example of liquid) of K, C, M, Y, CL, and W, respectively, and is disposed on a lower surface of the carriage 200. Each of the heads includes a piezo. When a drive signal is applied to the piezo by the CPU 33 (unit control circuit 31), the piezo performs contraction motion, pressure changes due to the contraction motion, and each of the heads thereby discharges the UV curable ink onto the recording medium 101. As a result, the liquid application surface 102 (an example of the liquid application surface) is formed on the recording medium 101.

Note that the number and arrangement of the heads are not limited to the embodiments as described above and can be appropriately changed.

Examples of a UV curable ink suitable for the present disclosure include an ink containing a methacrylate-based monomer. The methacrylate-based monomer has relatively weak skin sensibility advantageously but has a higher degree of curing shrinkage than an ordinary ink.

The irradiator 400 is disposed on a side surface (surface in the X axis direction) of the carriage 200 and emits UV light based on a drive signal from the CPU 33 (unit control circuit 31). The irradiator 400 mainly includes a UV irradiation lamp for emitting UV light.

Movement of the carriage 200 in the Z-axis direction (height direction) and the X-axis direction (main scanning direction) is controlled based on a drive signal from the CPU 33 (unit control circuit 31).

The carriage 200 performs a scan and moves in the main scanning direction (X axis direction) along the guides 201. A scanner 206 includes a driving pulley 203, a driven pulley 204, a driving belt 202, and a motor 205. The carriage 200 is fixed to the driving belt 202 wound around the driving pulley 203 and the driven pulley 204. The motor 205 drives the driving belt 202, and the carriage 200 thereby performs a scan and moves horizontally in the main scanning direction. The guides 201 are supported by side plates 211A and 211B of an apparatus main body. A height adjuster 207 includes a motor 209 and a slider 208. The height adjuster 207 drives the motor 209 to move the slider 208 vertically, and thereby moves the guides 201 vertically. By vertical movement of the guides 201, the carriage 200 moves vertically, and the height of the carriage 200 with respect to the recording medium 101 can be adjusted.

Hereinafter, image forming operation of the liquid discharge apparatus 1 is described.

First, the conveyor 100 moves in the Y-axis direction (sub-scanning direction) based on a drive signal from the CPU 33 (unit control circuit 31) and locates the recording medium 101 at an initial position for forming an image (liquid application surface 102).

Subsequently, the carriage 200 moves to a height suitable for discharge of a UV curable ink by the head unit 301 (for example, a height at which a gap between heads of the head unit 301 and the recording medium 101 is 1 mm) based on a drive signal from the CPU 33 (the unit control circuit 31). Note that the height of the head unit 301 is detected by the height sensor 41 and is thereby grasped by the CPU 33.

Subsequently, the carriage 200 reciprocates in the X-axis direction (main scanning direction) based on a drive signal from the CPU 33 (unit control circuit 31), and the head unit 301 discharges a UV curable ink based on the drive signal from the CPU 33 (unit control circuit 31) during this reciprocating movement. As a result, an image (liquid application surface 102) for one scan is formed on the recording medium 101.

Subsequently, when an image (liquid application surface 102) for one scan is formed on the recording medium 101, the conveyor 100 moves for one scan in the Y-axis direction (sub-scanning direction) based on the drive signal from the CPU 33 (unit control circuit 31).

Hereinafter, operation of forming an image (liquid application surface 102) for one scan and operation of moving the conveyor 100 for one scan in the Y axis direction are alternately performed until formation of the image (liquid application surface 102) is completed.

When the formation of the image (liquid application surface 102) on the recording medium 101 is completed, the process waits until the time when a UV curable ink is smoothed (hereinafter also referred to as "leveling time"). Thereafter, the irradiator 400 emits UV light.

First Embodiment

Next, a liquid discharge apparatus according to the present disclosure is described in detail.

Figure 5A:
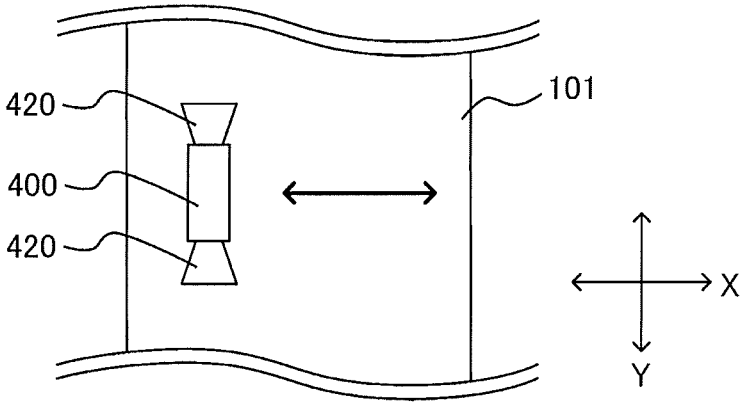
FIGS. 5A and 5B are a top view and a side view for explaining a main scanning direction, a sub-scanning direction, and a recording medium conveyance direction, respectively.
Figure 5B:
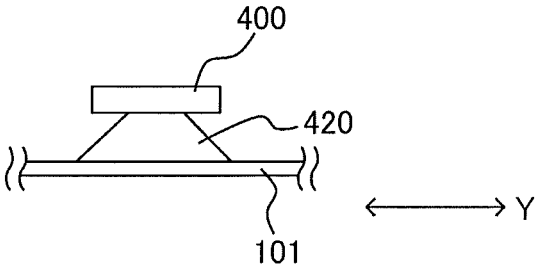

An example of image formation in the present disclosure is described with reference to FIGS. 5 and 6. FIGS. 5A and 5B are a top view and a side view for explaining a main scanning direction, a sub-scanning direction, and a recording medium conveyance direction, respectively. In FIG. 5A, the recording medium 101 and the irradiator 400 (an example of an irradiator) are illustrated. The irradiator 400 performs scanning in the main scanning direction X and emits a curing ray 420. FIG. 5B is a side view of FIG. 5A, and the irradiator 400 emits the curing ray 420. Note that the curing ray 420 is schematically illustrated.

Figure 6A:
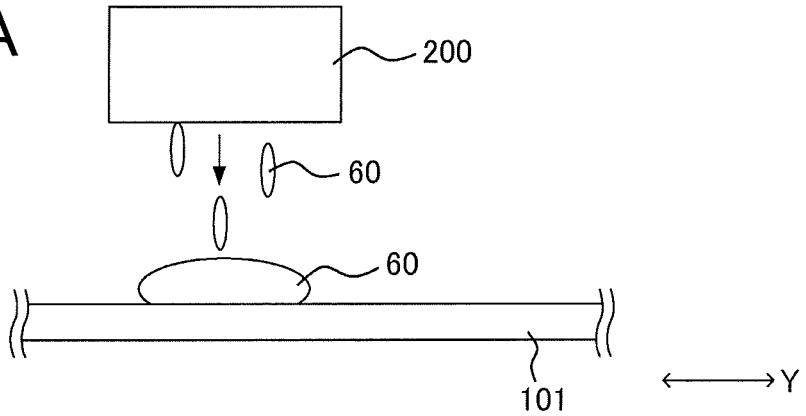
FIGS. 6A to 6C are side views for schematically explaining discharge of liquid, irradiation with a curing ray, and further discharge of liquid.
Figure 6B:
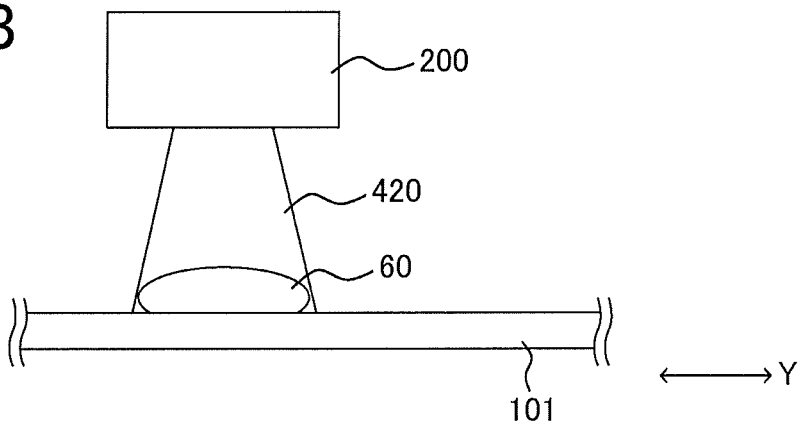
Figure 6C:
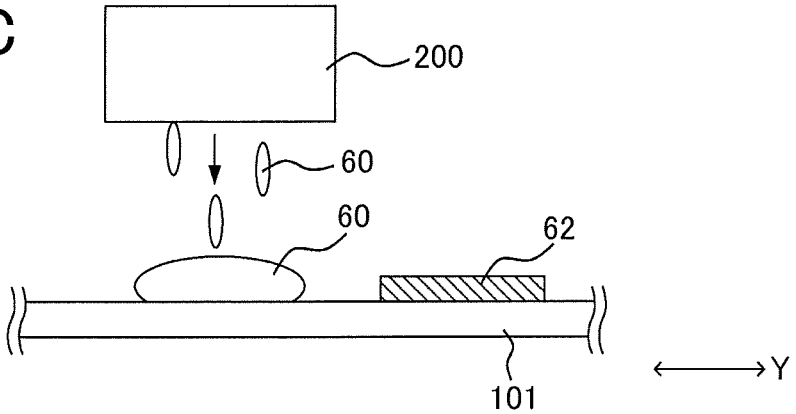

FIGS. 6A to 6C are side views for schematically explaining an example of discharge of liquid, irradiation with a curing ray, and further discharge of liquid, and illustrate elapse of time. The illustrated carriage 200 includes a member for discharging liquid and emitting light and performs a scan in the main scanning direction X, that is, in a direction orthogonal to the sub-scanning direction Y (backward direction of a sheet).

Note that a scan process from one end to the other end in the main scanning direction X is also referred to as a scan.

First, as illustrated in FIG. 6A, only discharge of a liquid 60 is performed during a scan. At this time, a curing ray is not emitted. Therefore, the liquid 60 is not cured, and a droplet thereof has a smooth surface due to surface tension. This step is also referred to as leveling or the like.

Subsequently, as illustrated in FIG. 6B, only irradiation with the curing ray 420 is performed in a subsequent scan. By performing either one of discharge of the liquid and irradiation with the curing ray for each scan, the liquid has a smooth surface. Meanwhile, in a case where the curing ray is emitted while the liquid is discharged, the liquid is cured in a state of a droplet. Therefore, the liquid has an uneven surface.

Subsequently, as illustrated in FIG. 6C, a cured film 62 is formed by irradiation with the curing ray 420. In a subsequent scan, as illustrated in FIG. 6A, only discharge of the liquid 60 is performed.

However, it is difficult to change irradiation with the curing ray according to a change in the degree of spreading of liquid in a wet state depending on an image forming environment, the type of liquid, the type of a recording medium, or the like.

When the liquid is irradiated with a curing ray, an appropriate area may not be irradiated with the curing ray in some cases, and a cured portion and an uncured portion may be generated in one scan during irradiation with the curing ray.

When the cured portion and the uncured portion are generated as described above, a boundary between the cured portion and the uncured portion is generated, and a band-shaped portion, so-called banding may occur in a recorded image. The banding is presumed to occur by curing shrinkage when liquid is irradiated with a curing ray to cause a chemical reaction.

The irradiator 400 performs a scan while emitting a certain amount of extra light (leakage light) in the sub-scanning direction. When a liquid discharge head, maintenance unit, or the like is irradiated with this leakage light, liquid is cured, and therefore this leads to failure of each member. Therefore, in order to suppress the above-described banding, it is not sufficient to merely increase the irradiation area. Incidentally, conventionally, controlling leakage light has been developed mainly in consideration of harmful effects on other members in many cases, and this is also a background of occurrence of banding.

However, varying the irradiation area of the curing ray in the sub-scanning direction (Y-direction) can reduce leakage of light in the sub-scanning direction (Y-direction).

Thus, the liquid discharge apparatus 1 according to present disclosure includes a liquid discharge head 300 to discharge a liquid onto a recording medium 101 conveyed in a sub-scanning direction, an irradiator 400 to irradiate the liquid discharged onto the recording medium 101 with a curing ray, an irradiation area of which is variable in the sub-scanning direction, and a scanner 206 to scan the liquid discharge head and the irradiator 400 in a main scanning direction (X-direction) perpendicular to the sub-scanning direction.

Further, the irradiator includes a varying unit disposed between the recording medium and the irradiator to vary the irradiation area.

Therefore, the liquid discharge apparatus 1 according to the present disclosure includes a liquid discharge head 300 for discharging liquid onto a recording medium 101, an irradiator 400 for irradiating liquid discharged onto the recording medium with a curing ray, and a varying unit 401 to vary an irradiation area of a curing ray emitted from the irradiator, the varying unit 401 being disposed between the recording medium and the irradiator. A direction perpendicular to a conveyance direction of the recording medium 101 is referred to as a main scanning direction (X-direction) and a direction parallel to the conveyance direction of the recording medium is referred to a sub-scanning direction (Y-direction). The liquid discharge head 300, the irradiator 400, and the varying unit 401 reciprocally moves (scans) in the main scanning direction, and the varying unit 401 varies the irradiation area in the sub-scanning direction to control leakage of light in the sub-scanning direction.

The liquid discharge apparatus 1 according to the present disclosure can reduce a size of the apparatus while reducing banding and has a simple configuration. The liquid discharge apparatus 1 according to the present disclosure can produce a high-quality image while preventing banding.

According to the present disclosure, not only simply block a leakage light but also the varying unit 401 varies an irradiation area of the curing ray in the sub-scanning direction (Y-direction). Therefore, it is possible to control glossiness of an obtained image. Even if the same liquid to be discharged is used, it is possible to easily select a glossy image or a mat image.

Next, with reference to FIGS. 7 to 11, an aspect in which the varying unit 401 varies an irradiation area in the sub-scanning direction and controls leakage light in the sub-scanning direction is described.

Figure 7A:
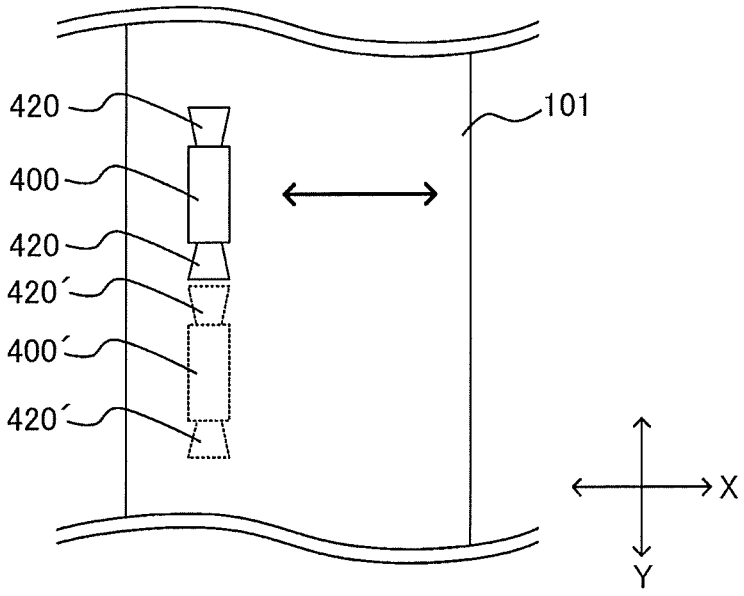
FIGS. 7A and 7B are a top view and a side view for schematically explaining a main part of an example of a liquid discharge apparatus according to an embodiment of the present disclosure, respectively (pattern A)
Figure 8A:
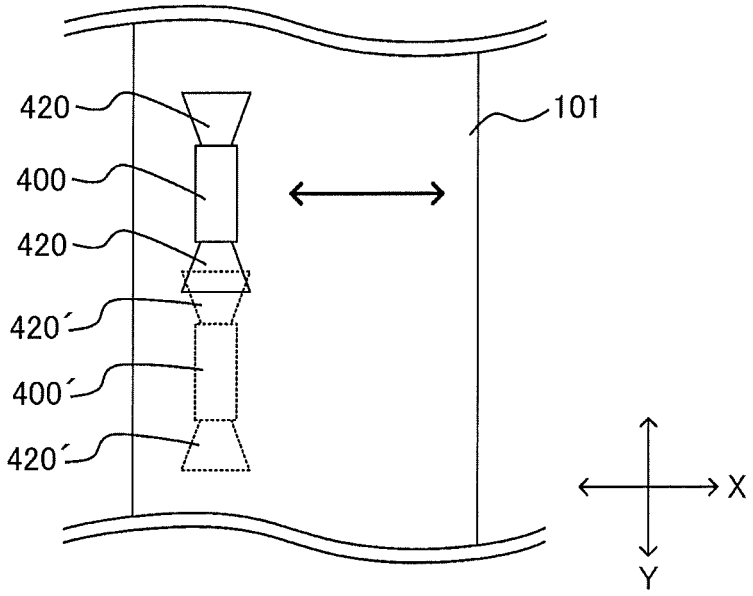
FIGS. 8A and 8B are a top view and a side view for schematically explaining a main part of another example of a liquid discharge apparatus according to an embodiment of the present disclosure, respectively (pattern B)

FIGS. 7A and 8A are top views for schematically explaining a main part of the liquid discharge apparatus according to the present disclosure and illustrate an example in which the irradiator 400 emits the curing ray 420. The irradiator 400 performs a scan in the main scanning direction X as indicated by an arrow in FIGS. 7A and 8A. The recording medium 101 is conveyed in the sub-scanning direction Y.

Figure 7B:
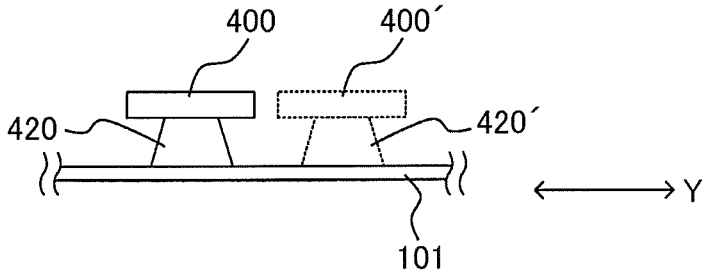
Figure 8B:
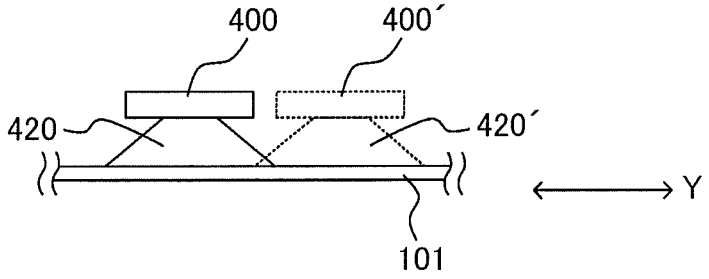

FIGS. 7B and 8B are side views for schematically explaining a main part of the liquid discharge apparatus according to the present disclosure. The irradiator 400 and the curing ray 420 illustrated by solid lines indicate a current scan, and an irradiator 400' and a curing ray 420' illustrated by broken lines indicate a pre-scan.

In FIGS. 7A, 7B, 8A, and 8B, the irradiator 400 and the curing ray 420 illustrated by solid lines indicate a current scan, and an irradiator 400' and a curing ray 420' illustrated by broken lines indicate a pre-scan.

Figure 9:
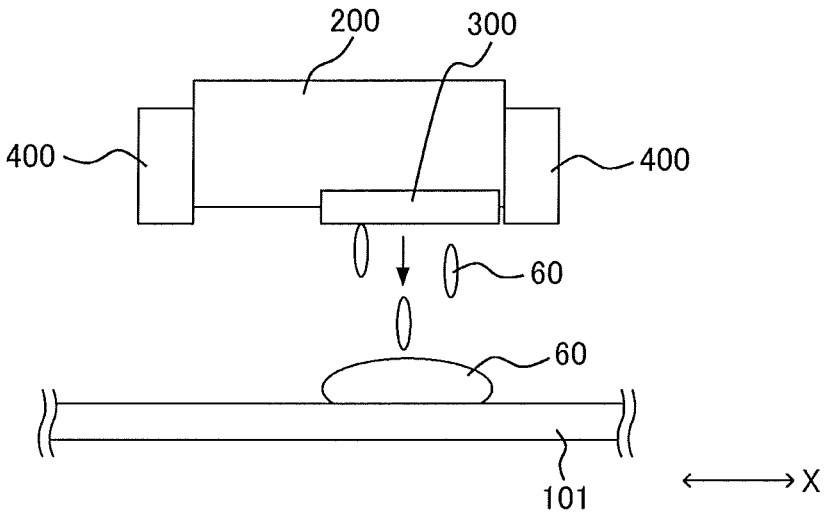
FIG. 9 is a front view of an example of a liquid discharge apparatus according to an embodiment of the present disclosure.
Figure 10:
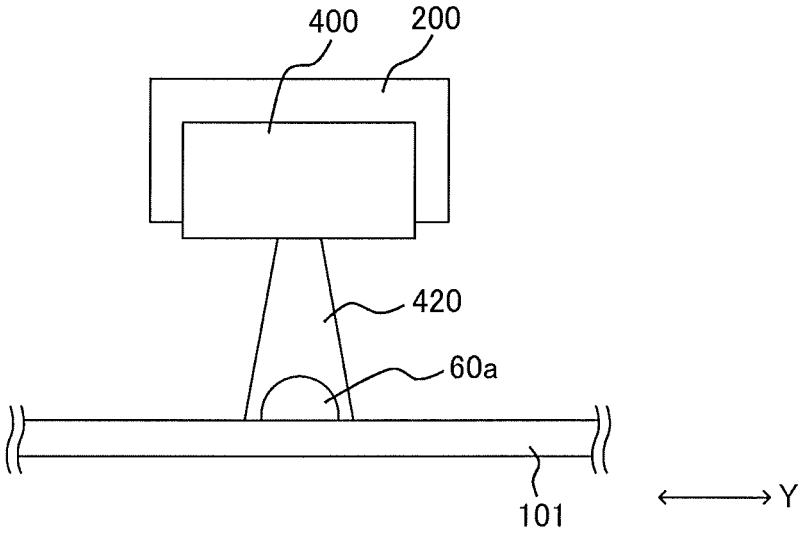
FIG. 10 is a side view of an example of a liquid discharge apparatus according to an embodiment of the present disclosure (pattern A)
Figure 11:
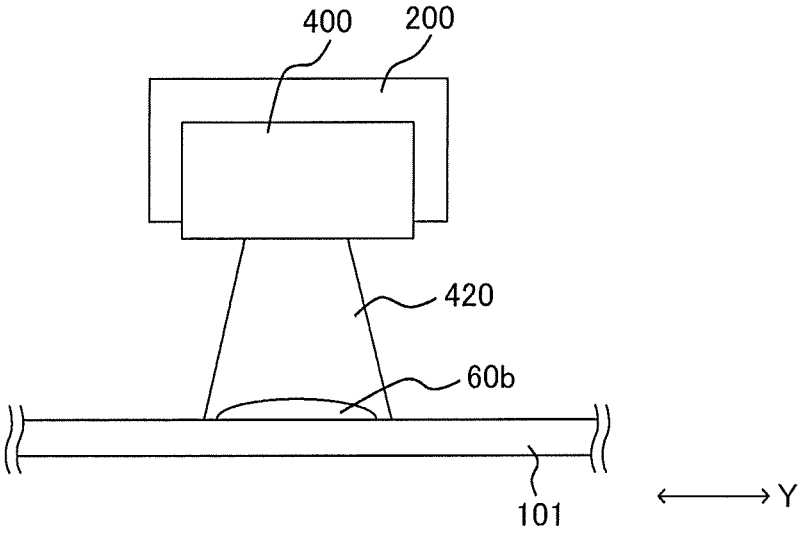
FIG. 11 is a side view of another example of a liquid discharge apparatus according to an embodiment of the present disclosure (pattern B)

FIG. 9 is a front view for schematically explaining a main part in the present disclosure. FIGS. 10 and 11 are side views for schematically explaining a main part in the present disclosure, which are different side views of FIGS. 7B and 8B, respectively, also illustrating the liquid 60.

Here, description is be made by referring to FIGS. 7 and 10 for reducing an irradiation area as pattern A and referring to FIGS. 8 and 11 for enlarging the irradiation area as pattern B.

Incidentally, in the present disclosure, enlarging the irradiation area means varying the irradiation area in a direction in which the irradiation area is increased, and reducing the irradiation area means varying the irradiation area in a direction in which the irradiation area is reduced.

When pattern A is compared with pattern B, there is a difference in the irradiation area of the curing ray 420 with respect to the sub-scanning direction Y The irradiation area in pattern A is small, and the irradiation area in pattern B is large.

In pattern A, as illustrated in FIG. 10, discharged liquid in a droplet shape is irradiated with a curing ray, and a reduced irradiation area is irradiated with the curing ray 420 to cure the liquid. As a result, the liquid is cured in a state having an uneven shape.

Meanwhile, in pattern B, as illustrated in FIG. 11, discharged liquid is irradiated with a curing ray in a state in which the liquid spreads in a wet state, and an enlarged irradiation area is irradiated with the curing ray 420 to cure the liquid. As a result, the liquid is cured in a state in which the liquid spreads in a wet state, and has a smoother surface than the liquid in pattern A.

In addition, both patterns A and B control leakage light in the sub-scanning direction, and therefore can prevent failure of each member caused by irradiation with light on a liquid discharge head, a maintenance unit, or the like.

As a result of irradiation with a curing ray in an area larger than the area of the discharged liquid in the sub-scanning direction, a curing ray not contributing to curing is generated. In the present disclosure, this curing ray is referred to as leakage light in the sub-scanning direction.

In the present disclosure, controlling the leakage light means that an irradiation area equal to or larger than the area of discharged liquid in the sub-scanning direction and having a sufficiently reduced curing ray not contributing to curing is irradiated with a curing ray.

Next, an image obtained by the present disclosure is described with reference to FIGS. 12 to 14.

Figure 12:
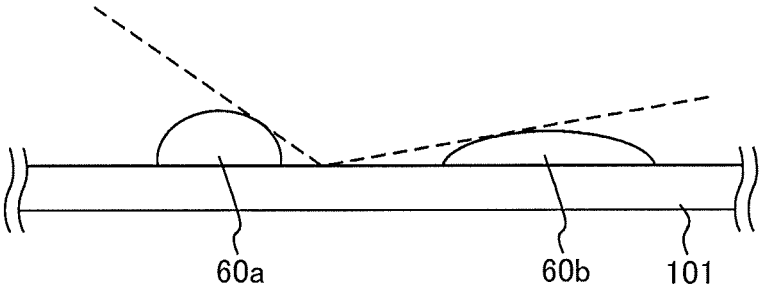
FIG. 12 is a schematic cross-sectional view for explaining a difference in how liquid spreads in a wet state.

FIG. 12 is a schematic cross-sectional view in a case where the liquid 60 is discharged onto a recording medium. The shape of the liquid 60 changes depending on, for example, an elapse of time after the liquid 60 is discharged onto the recording medium or a relationship between surface tension of the liquid and surface energy of the recording medium, such as a droplet or a spread shape in a wet state. A liquid 60*a* on the left side in FIG. 12 has a drop shape, and a liquid 60*b* on the right side in FIG. 12 has a shape in which the liquid spreads in a wet state.

Figure 13:
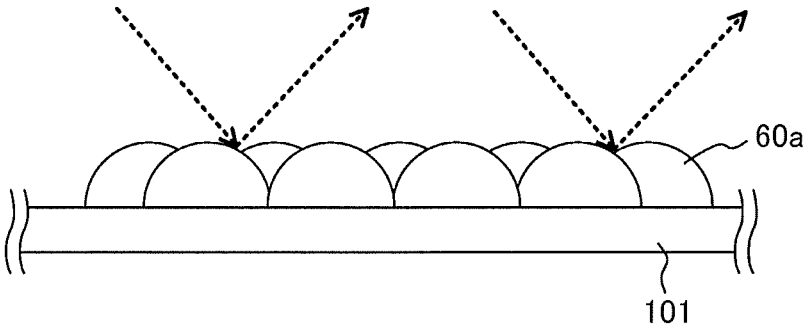
FIG. 13 is a schematic cross-sectional view for explaining an example of an image obtained by the present disclosure.

FIG. 13 is a cross-sectional view schematically illustrating an example of an image obtained in pattern A illustrated in FIGS. 7 and 10. In pattern A, liquid discharged onto a recording medium is cured in a droplet shape before the liquid spreads in a wet state. Therefore, the shape of the cured liquid maintains the state of a sphere as illustrated in FIG. 13. In the state of a sphere, the angle of reflected light is also large when light enters the liquid. Therefore, a mat image without glossiness is recognized when this light is captured by naked eyes.

Figure 14:
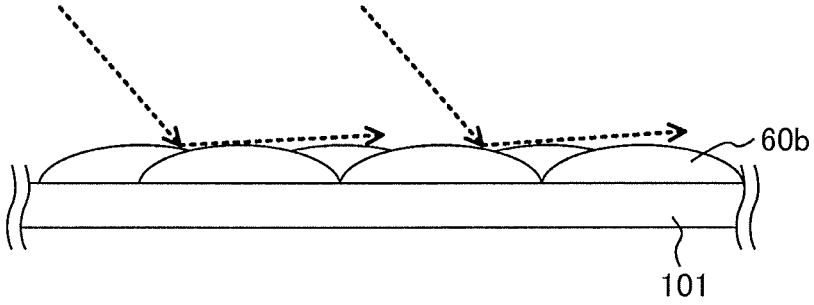
FIG. 14 is a schematic cross-sectional view for explaining another example of an image obtained by the present disclosure.

Meanwhile, FIG. 14 is a cross-sectional view schematically illustrating an example of an image obtained in pattern B illustrated in FIGS. 8 and 11. In pattern B, liquid discharged onto a recording medium is cured in a state in which the liquid spreads in a wet state. Therefore, the cured liquid has a shape in which the liquid spreads in a wet state as illustrated in FIG. 14. In a case where the liquid is irradiated with light in a state in which the liquid spreads in a wet state on the recording medium in this way, the liquid is cured while having a smooth surface. For this reason, the angle of reflected light is small, and a glossy image is recognized.

Figure 15:
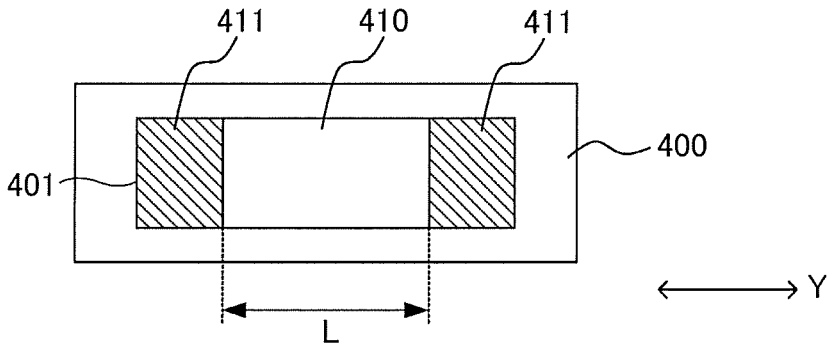
FIG. 15 is a schematic view for explaining an example of an irradiator.
Figure 16:
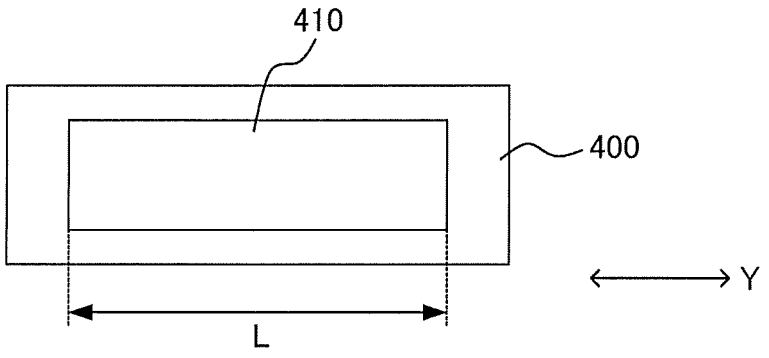
FIG. 16 is a schematic view for explaining another example of an irradiator.

A method for controlling an irradiation area in the present disclosure is described with reference to FIGS. 15 and 16. FIGS. 15 and 16 are schematic top views when the irradiator 400 is seen from the side of the recording medium 101.

The irradiator according to the present embodiment includes a light source therein and irradiates a recording medium with a curing ray from a light source substantially perpendicular to the recording medium. The light source is protected by several transparent glass filters and the like, and an outermost surface to be exposed to outside air is referred to as a window surface 410.

The varying unit 401 in the present disclosure includes a shutter 411 (shield). By making the shutter 411 openable and closable with respect to the sub-scanning direction Y, the irradiation area of a curing ray is varied.

FIG. 15 illustrates an example of a case where the shutter 411 shields a part of the window surface 410 to reduce an irradiation area. FIG. 16 illustrates an example of a case where the shutter 411 does not shield the window surface 410 to enlarge the irradiation area. Here, the length L of the window surface 410 in the sub-scanning direction is represented as the irradiation area.

Note that the shutter 411 only needs to be able to shield a curing ray, and a material or the like thereof can be appropriately changed.

Figure 17:
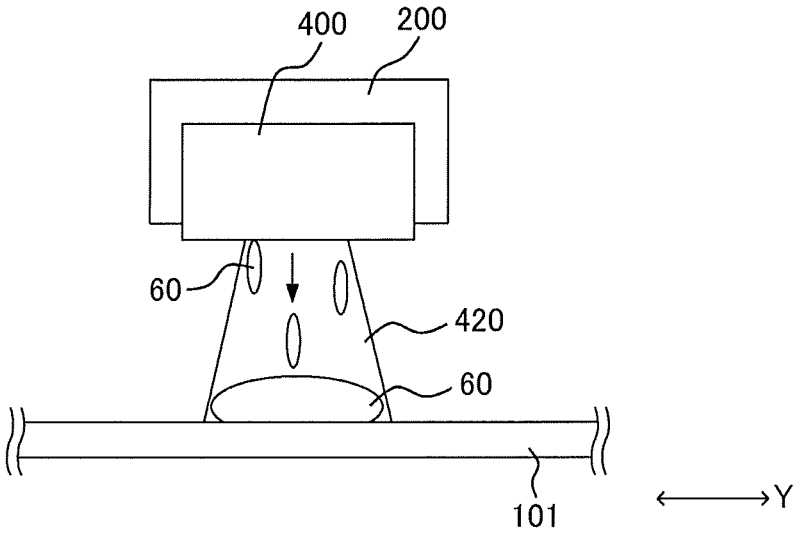
FIG. 17 is a schematic diagram for explaining an example of a method for varying an irradiation area.
Figure 18:
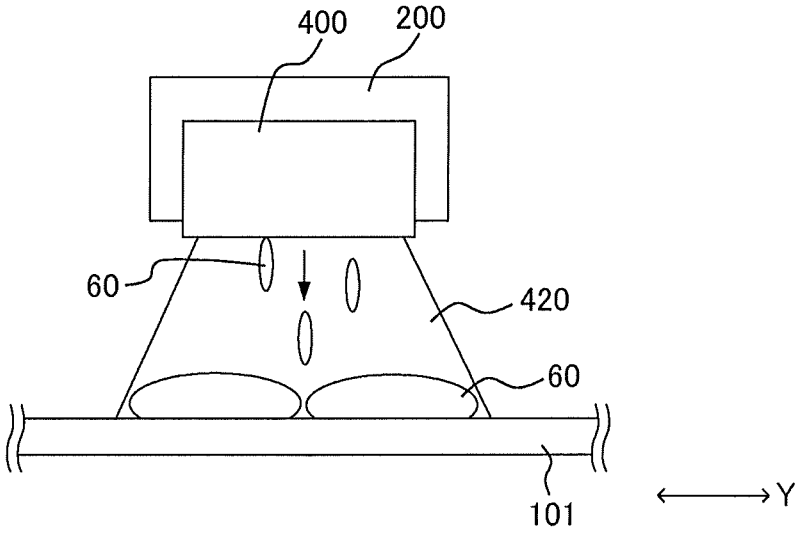
FIG. 18 is a schematic diagram for explaining another example of a method for varying an irradiation area.

Next, another image formation in the present disclosure is described with reference to FIGS. 17 and 18. FIGS. 17 and 18 are side views for schematically explaining a main part similarly to FIGS. 10 and 11.

FIG. 17 illustrates an example of a case where discharge of liquid and irradiation with a curing ray are performed in one scan or a case where irradiation with a curing ray is performed in a subsequent scan after discharge of liquid is performed. In this case, the irradiation area of the curing ray in the sub-scanning direction is reduced, and the liquid is cured.

FIG. 18 illustrates an example of a case where irradiation with a curing ray is not performed at the same time as a scan in which discharge of liquid is performed or a subsequent scan but irradiation with a curing ray is performed after discharge of liquid is performed by movement of a liquid discharge head in the sub-scanning direction. Here, liquids for two lines are irradiated with the curing ray at the same time. In this case, the irradiation area of the curing ray in the sub-scanning direction is enlarged, and the liquid is cured.

In this way, by having a mechanism for varying the irradiation area of the curing ray, it is also possible to cope with an image forming method such as discharging liquid in continuous scans and irradiation with the curing ray is performed at once in a subsequent scan. Even in this case, it is possible to obtain a favorable image in which occurrence of banding is suppressed.

Second Embodiment

Next, a liquid discharge apparatus according to another embodiment of the present disclosure is described. Note that description of matters similar to those in the above embodiments are omitted.

A varying unit 401 in the present disclosure varies an irradiation area according to magnitudes of a value of surface tension of liquid and a value of surface energy of a recording medium.

A difference between a value of surface tension of liquid and a value of surface energy of a recording medium makes a difference in the shape of liquid discharged onto the recording medium as illustrated in FIG. 12. In a case where surface tension of liquid is larger than surface energy of a recording medium (surface tension of liquid>surface energy of recording medium), for example, the liquid has such a shape as a liquid 60*a* on the left side in FIG. 12. Meanwhile, in a case where surface tension of liquid is smaller than surface energy of a recording medium (surface tension of liquid<surface energy of recording medium), for example, the liquid has such a shape as a liquid 60*b* on the right side in FIG. 12.

For this reason, in a case where surface tension of liquid is larger than surface energy of a recording medium, the liquid 60*a* is irradiated with a curing ray in an irradiation area reduced as in the above pattern A (FIGS. 7 and 10) to be cured. Meanwhile, in a case where surface tension of liquid is smaller than surface energy of a recording medium, the liquid 60*b* is irradiated with a curing ray in an irradiation area enlarged as in the above pattern B (FIGS. 8 and 11) to be cured.

The varying unit 401 preferably enlarges the irradiation area in a case where a value of surface tension of liquid is larger than a value of surface energy of a recording medium. Meanwhile, the varying unit 401 preferably reduces the irradiation area in a case where a value of surface tension of liquid is smaller than a value of surface energy of a recording medium.

Incidentally, enlarging an irradiation area in the present disclosure means enlarging the irradiation area as compared with a case where surface tension of liquid and surface energy of a recording medium are substantially equal to each other, and reducing the irradiation area in the present disclosure means reducing the irradiation area as compared with a case where surface tension of liquid and surface energy of a recording medium are substantially equal to each other.

According to the present disclosure, extra curing rays in the sub-scanning direction can be further suppressed, and generation of a liquid uncured portion and a liquid cured portion in the sub-scanning direction can be further suppressed.

The surface energy of a recording medium depends on, in particular, unevenness of the recording medium. However, if the unevenness can be neglected, the surface energy is roughly divided into a case where the recording medium contains an organic substance and a case where the recording medium contains an inorganic substance.

In a case where the recording medium contains a polymer compound, the surface energy thereof tends to be large. A plastic sheet, a plastic film, a surface-treated metal, and the like correspond thereto. In a case where the surface energy is large, liquid easily spreads in a wet state, and therefore the irradiation area is preferably enlarged as described above.

Meanwhile, in a case where the recording medium contains an inorganic substance such as a metal, the surface energy tends to be small. Therefore, it is difficult for liquid to spread in a wet state after an ink lands on the medium, and the liquid maintains a spherical shape. For this reason, if an irradiation width is large, there is a risk that another image region may be irradiated with leakage light. Therefore, control is preferably performed so as to reduce the irradiation area.

In consideration of the above, although not limited thereto, the irradiation area is preferably varied depending on whether or not the recording medium contains an organic substance having a molecular weight of 1000 or more.

Examples of the organic substance having a molecular weight of 1000 or more include wood.

In a case where the recording medium contains an organic substance having a molecular weight of 1000 or more, a reduced irradiation area is preferably irradiated with a curing ray as illustrated in FIG. 10 (pattern A). In a case where the recording medium contains no organic substance having a molecular weight of 1000 or more, an enlarged irradiation area is preferably irradiated with a curing ray as illustrated in FIG. 11 (pattern B).

Here, the case where the recording medium contains an organic substance having a molecular weight of 1000 or more means that the recording medium has an average molecular weight of 1000 or more.

The surface tension of liquid and the surface energy of the recording medium can be measured by a known method and apparatus. For example, the surface tension is measured by a Wilhelmy method (plate method), and the surface energy is measured by an Inverse Gas Chromatography-Surface Energy Analyzer (iGC-SEA).

The varying unit 401 preferably enlarges the irradiation area in a case where the recording medium contains an organic substance having a molecular weight of 1000 or more. Meanwhile, the varying unit 401 preferably reduces the irradiation area in a case where the recording medium contains no organic substance having a molecular weight of 1000 or more.

In this case, extra curing rays in the sub-scanning direction can be further suppressed, and generation of a liquid uncured portion and a liquid cured portion in the sub-scanning direction can be further suppressed.

Incidentally, in the present disclosure, enlarging the irradiation area means enlarging the irradiation area as compared with a case where the recording medium contains no organic substance having a molecular weight of 1000 or more, and reducing the irradiation area means reducing the irradiation area as compared with a case where the recording medium contains an organic substance having a molecular weight of 1000 or more.

Third Embodiment

Next, a liquid discharge apparatus according to another embodiment of the present disclosure is described. Note that description of matters similar to those in the above embodiments are omitted.

A varying unit 401 in the present disclosure varies an irradiation area according to the number of times a liquid discharge head scans the same position (same area) on a recording medium (also referred to as the number of printing passes or the number of passes).

Figure 19:
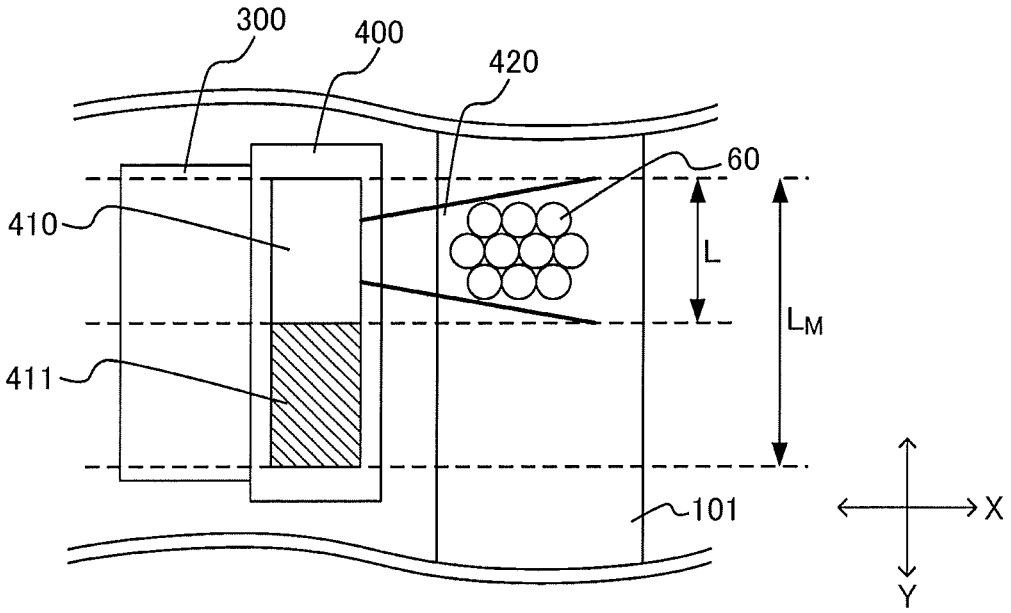
FIG. 19 is a schematic diagram for explaining another example of a method for varying an irradiation area.
Figure 20:
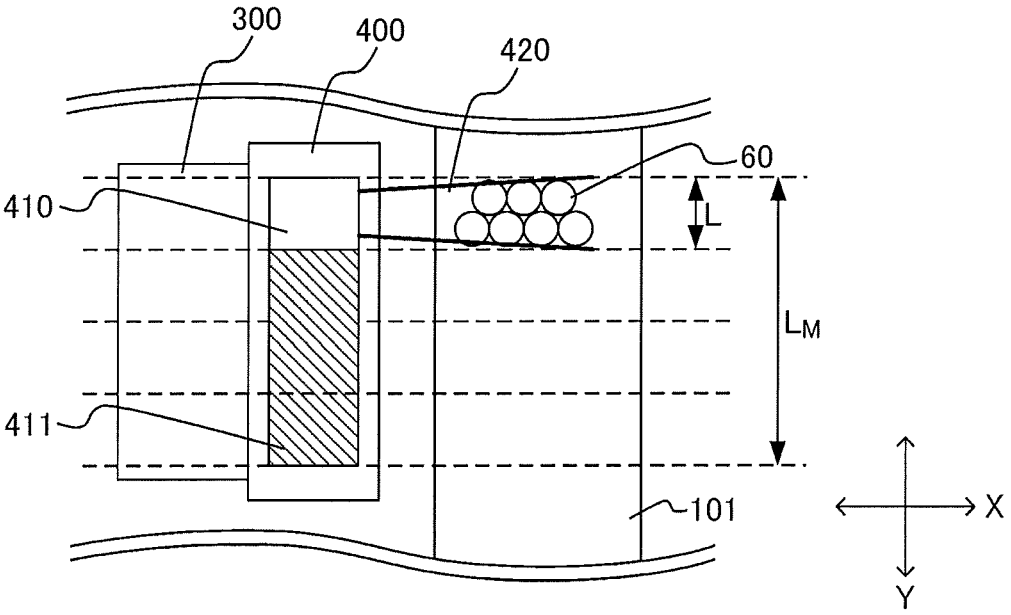
FIG. 20 is a schematic diagram for explaining another example of a method for varying an irradiation area.

The present disclosure is described with reference to FIGS. 19 and 20. FIGS. 19 and 20 are diagrams for schematically explaining variation of an irradiation area in the present disclosure. An irradiator 400 in FIGS. 19 and 20 schematically illustrates a case where the irradiator 400 is seen from the side of a recording medium 101.

FIG. 19 illustrates an example of a case where the number of printing passes is two. The number of printing passes means the number of times a liquid discharge head scans the same position (same area) on a recording medium. A case where a scan is performed on the recording medium from one end to the other end in the main scanning direction is defined as one pass. At this time, usually, a route returning from the other end to the one end is not counted as one pass. That is, in a case where the liquid discharge head performs a reciprocal scan in the main scanning direction, only a forward route is counted as one pass.

However, when liquid is discharged also in a backward route, the backward route is also counted as one pass.

In the present disclosure, the irradiation area is varied according to the number of passes. In the example in which the number of passes is two as illustrated in FIG. 19, the irradiation area in the sub-scanning direction is preferably equal to or larger than a projected area of a nozzle surface of a liquid discharge head and equal to or smaller than ½ of a maximum value.

Incidentally, in FIG. 19, the irradiation area is represented by the length of a window surface 410, a maximum value of the irradiation area in the sub-scanning direction is represented by LM, and ½ of the irradiation area is represented by L.

As the number of printing passes increases, the number of used nozzles in one scan decreases, and therefore the image area in one pass decreases. As a result, the irradiation area can be controlled without requiring extra curing rays.

Incidentally, even in a case where the number of passes is three, the irradiation area is varied as in the case where the number of passes is two.

As the number of passes increases, the irradiation area is preferably reduced. For example, in a case where the number of passes is four or more, the irradiation area in the sub-scanning direction is preferably equal to or larger than a projected area of a nozzle surface of a liquid discharge head and equal to or smaller than ¼ of a maximum value. FIG. 20 illustrates an example of a case where the number of passes is four, and the irradiation area is set to ¼ of a maximum value.

According to the present disclosure, extra curing rays in the sub-scanning direction can be further suppressed, and generation of a liquid uncured portion and a liquid cured portion in the sub-scanning direction can be further suppressed.

Fourth Embodiment

Next, a liquid discharge apparatus according to another embodiment of the present disclosure is described. Note that description of matters similar to those in the above embodiments are omitted.

An irradiator in the present disclosure includes light sources of a plurality of light-emitting diodes (LED), and varies an irradiation area in a sub-scanning direction by controlling a lighting of the plurality of LED such as partially lighting the LED. That is, in the present disclosure, in addition to varying the irradiation area by the varying unit 401, the irradiator varies the irradiation area.

Figure 21:
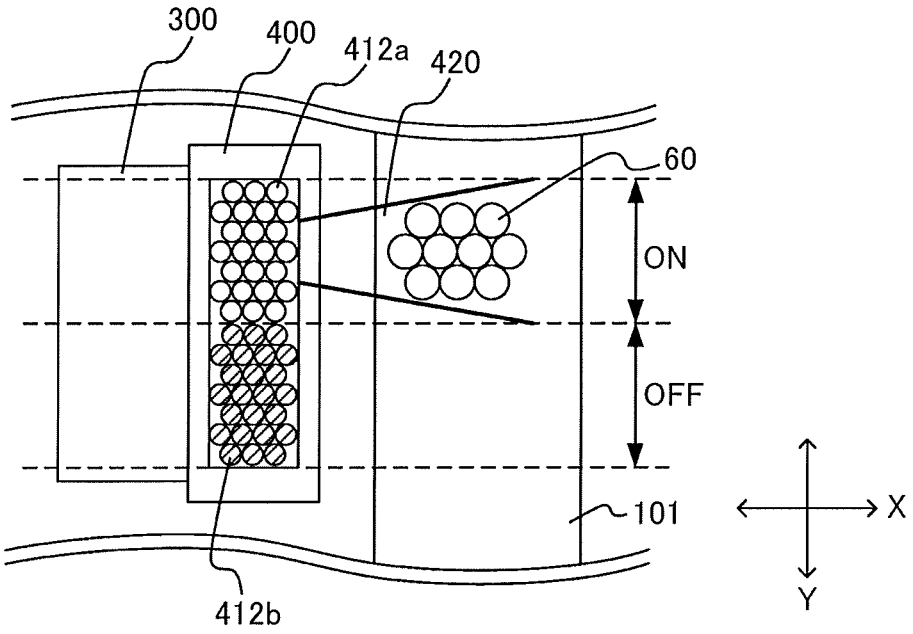
FIG. 21 is a schematic diagram for explaining another example of an irradiator according to an embodiment of the present disclosure.
Figure 22A:
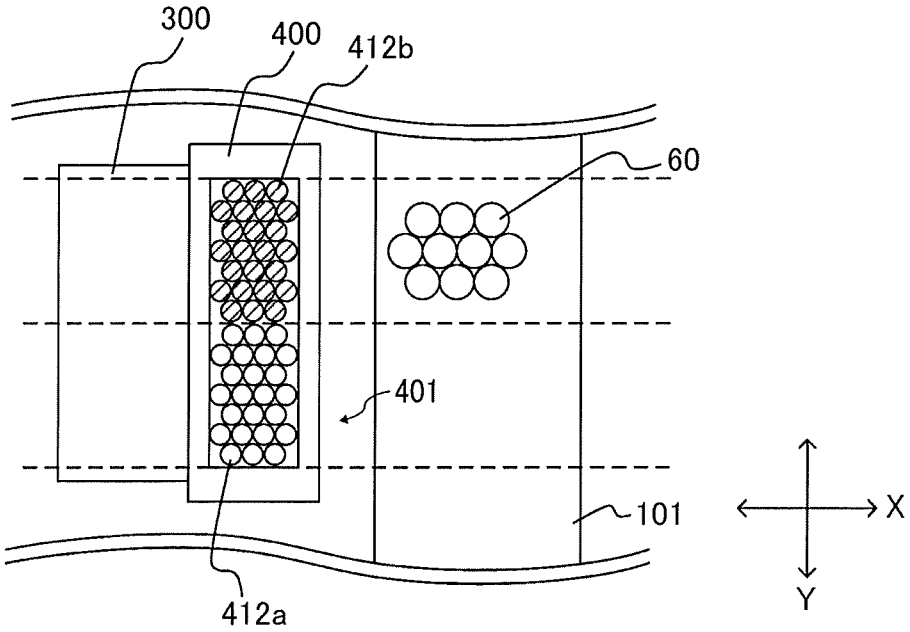
FIGS. 22A and 22B are schematic diagrams for explaining another example of an irradiator according to an embodiment of the present disclosure.
Figure 22B:
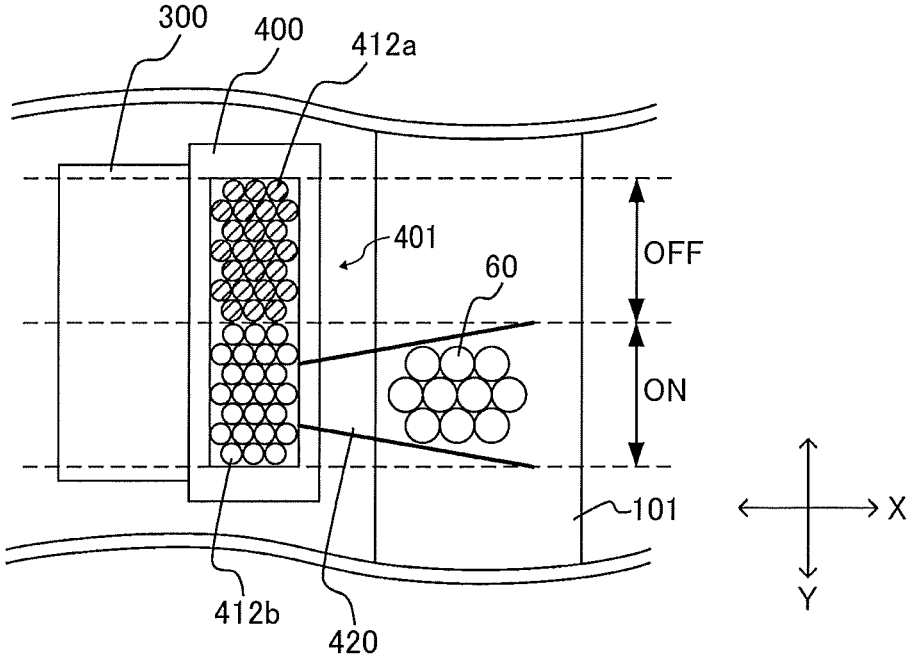

The present disclosure is described with reference to FIGS. 21, 22A, and 22B. FIGS. 21, 22A, and 22B are diagrams for schematically explaining variation of the irradiation area in the present disclosure, and schematically illustrate a case where an irradiator 400 is seen from the side of a recording medium 101.

FIG. 21 illustrates pattern C as an example of image formation. In pattern C, discharge of liquid and irradiation with a curing ray are performed in one scan. Therefore, irradiation with a curing ray is performed immediately after liquid is discharged. In this case, an LED light source is partially lit such that the irradiation area has a width corresponding to one scan, and an unused portion is extinguished. In pattern C, a mat image without glossiness is mainly obtained.

FIGS. 22A and 22B illustrate pattern D as an example of image formation. FIG. 22A illustrates a scan at a certain time (referred to as a first scan), and FIG. 22B illustrates a subsequent scan (referred to as a second scan). In pattern D, as illustrated in FIG. 22A, only discharge of liquid is performed in the first scan, and the discharged liquid is not irradiated with a curing ray immediately after the discharge. Subsequently, a liquid discharge head and an irradiator move in the sub-scanning direction. After the movement, irradiation with a curing ray is performed at the timing of the second scan. At this time, similarly to FIG. 21, an LED light source is partially lit by the width of a used head to cure liquid. In pattern D, the liquid is cured in a state in which the liquid spreads in a wet state on a recording medium. Therefore, a glossy image is mainly obtained.

In this way, in addition to varying the irradiation area by the varying unit 401, by varying the irradiation area by the irradiator, it is possible to accurately adjust not only the range of leakage light but also the intensity (light amount) of the leakage light, to select a glossy image or a mat image without glossiness, and to suppress occurrence of banding at a higher level.

Fifth Embodiment

Next, a liquid discharge apparatus according to another embodiment of the present disclosure is described. Note that description of matters similar to those in the above embodiments are omitted.

A varying unit 401 in the present disclosure varies the irradiation area according to time from discharge of liquid by a liquid discharge head to irradiation on the liquid with a curing ray by an irradiator.

In the present disclosure, the shape of liquid on a recording medium is controlled by the timing at which a curing ray is emitted after the liquid lands on the recording medium, that is, the timing at which the liquid is cured.

For example, as described in the above first embodiment, in the method for emitting light immediately after landing of liquid to cure an ink, the ink is cured before the ink spreads in a wet state. Therefore, the shape of the cured liquid maintains the state of a sphere as illustrated in FIG. 13. Meanwhile, in a case where the liquid is irradiated with light in a state in which the liquid spreads in a wet state on the recording medium, the liquid is cured while having a smooth surface as illustrated in FIG. 14.

Some conventional techniques adjust the timing of emitting a curing ray after liquid is discharged. However, in this case, curing is performed while leakage light in the sub-scanning direction is generated, the irradiation area is insufficient, or a cured portion and an uncured portion are generated disadvantageously.

Meanwhile, according to the present disclosure, by varying the irradiation area according to how liquid spreads in a wet state in consideration of spread of the liquid in a wet state on a recording medium, the liquid can be cured with a sufficient irradiation area while leakage light in the sub-scanning direction is suppressed. For this reason, it is possible to obtain a favorable image in which occurrence of banding is suppressed, and to control glossiness of an image obtained with the same liquid.

Numerous additional modifications and variations are possible in light of the above teachings. Such modifications and variations are not to be regarded as a departure from the scope of the present disclosure and appended claims, and all such modifications are intended to be included within the scope of the present disclosure and appended claims.

What is claimed is:

1. A liquid discharge apparatus, comprising:

a liquid discharge head to discharge a liquid onto a recording medium conveyed in a sub-scanning direction;

an irradiator to irradiate the liquid discharged onto the recording medium with a curing ray;

a shutter to variably cover a part of the irradiator to vary an irradiation area of the curing ray in the sub-scanning direction; and a scanner to scan the liquid discharge head and the irradiator in a main scanning direction perpendicular to the sub-scanning direction.

2. The liquid discharge apparatus according to claim 1, wherein the shutter is disposed between the recording medium and the irradiator to vary the irradiation area.

3. The liquid discharge apparatus according to claim 1, wherein the shutter is movable to a first position to reduce the irradiation area in the sub-scanning direction.

4. The liquid discharge apparatus according to claim 1, wherein the irradiator includes a plurality of light-emitting diodes and controls lighting of the plurality of light-emitting diodes to vary the irradiation area.

5. The liquid discharge apparatus according to claim 1, further comprising control circuitry configured to cause the irradiator to vary the irradiation area according to a number of times of scanning of the scanner scanning the liquid discharge head and the irradiator in a same area of the recording medium.

6. The liquid discharge apparatus according to claim 5, wherein the control circuitry is further configured to cause the irradiator to reduce the irradiation area with an increase in the number of times of scanning of the scanner.

7. The liquid discharge apparatus of claim 1, wherein the irradiator includes an outer window, and the shutter variably covers a portion of the outer window.

8. A method for discharging a liquid, the method comprising:

discharging a liquid onto a recording medium conveyed in a sub-scanning direction;

irradiating the liquid discharged onto the recording medium with a curing ray, an irradiation area of the curing ray being variable in the sub-scanning direction with a shutter that variably covers a part of the irradiator; and scanning a position of the discharging and a position of the irradiating in a main scanning direction perpendicular to the sub-scanning direction.

9. The method according to claim 8, wherein the irradiating step comprises varying the irradiation area according to a value of surface tension of the liquid and a value of surface energy of the recording medium.

10. The method according to claim 8, wherein the irradiating step comprises varying the irradiation area according to whether the recording medium contains an organic substance having a molecular weight of 1000 or more.

11. The method according to claim 10, wherein the irradiating step comprises increasing the irradiation area when the recording medium contains the organic substance having a molecular weight of 1000 or more, and decreasing the irradiation area when the recording medium does not contain the organic substance having a molecular weight of 1000 or more.

12. The method according to claim 8, wherein the irradiating step comprises varying the irradiation area according to time from the discharging to the irradiating.

* * * * *